US008356658B2

(12) United States Patent
Bunker et al.

(10) Patent No.: US 8,356,658 B2
(45) Date of Patent: Jan. 22, 2013

(54) HEAT TRANSFER ENHANCING SYSTEM AND METHOD FOR FABRICATING HEAT TRANSFER DEVICE

(75) Inventors: Ronald Scott Bunker, Niskayuna, NY (US); Wayne Charles Hasz, Pownal, VT (US)

(73) Assignee: General Electric Company, Niskayuna, NY (US)

( * ) Notice: Subject to any disclaimer, the term of this patent is extended or adjusted under 35 U.S.C. 154(b) by 1491 days.

(21) Appl. No.: 11/460,362

(22) Filed: Jul. 27, 2006

(65) Prior Publication Data

US 2008/0023179 A1 Jan. 31, 2008

(51) Int. Cl.
*F28F 13/12* (2006.01)
*H01F 3/00* (2006.01)

(52) U.S. Cl. ..... 165/109.1; 165/133

(58) Field of Classification Search ..... 165/109.1, 165/133, 134.1, 166, 181; 428/566
See application file for complete search history.

(56) References Cited

U.S. PATENT DOCUMENTS

| | | | | | |
|---|---|---|---|---|---|
| 3,457,990 | A | * | 7/1969 | Theophilos et al. | 165/133 |
| 3,587,730 | A | * | 6/1971 | Milton | 165/110 |
| 3,762,011 | A | * | 10/1973 | Staudhammer et al. | 419/2 |
| 4,060,125 | A | * | 11/1977 | Fujie et al. | 165/133 |
| 4,154,294 | A | * | 5/1979 | Notaro | 165/133 |
| 4,653,572 | A | * | 3/1987 | Bennett et al. | 165/133 |
| 4,715,433 | A | * | 12/1987 | Schwarz et al. | 165/110 |
| 4,729,428 | A | | 3/1988 | Yasutake et al. | |
| 4,794,983 | A | * | 1/1989 | Yoshida et al. | 165/133 |
| 5,014,773 | A | * | 5/1991 | Beduz et al. | 165/115 |
| 6,254,997 | B1 | | 7/2001 | Retig et al. | |
| 6,402,464 | B1 | * | 6/2002 | Chiu et al. | 415/116 |
| 6,468,669 | B1 | | 10/2002 | Hasz et al. | |
| 6,598,781 | B2 | | 7/2003 | Hasz et al. | |
| 6,846,575 | B2 | * | 1/2005 | Hasz et al. | 428/606 |
| 7,360,581 | B2 | * | 4/2008 | Tuma et al. | 165/80.3 |
| 2005/0039898 | A1 | | 2/2005 | Wand et al. | |

FOREIGN PATENT DOCUMENTS

| | | | |
|---|---|---|---|
| EP | 1050663 | | 11/2000 |
| EP | 1557627 | | 7/2005 |
| JP | 59024538 | A * | 2/1984 |
| JP | 60253793 | A | 12/1985 |
| JP | 61006596 | A | 1/1986 |
| JP | 62178890 | A | 8/1987 |
| WO | 2004035992 | | 4/2004 |

OTHER PUBLICATIONS

EP Search Report, EP 07119401, Mar. 6, 2008.
CPME0744351, First Office Action Jul. 16, 2010.

* cited by examiner

*Primary Examiner* — Tho V Duong
(74) *Attorney, Agent, or Firm* — Ann M. Agosti

(57) ABSTRACT

A heat transfer device includes a plurality of heat transfer walls configured to separate a first fluid and a second fluid. A heat transfer enhancing system is provided to one or more heat transfer walls. The heat transfer enhancing system includes a plurality of micro turbulating particles bonded to the one or more heat transfer walls using a binding medium.

7 Claims, 9 Drawing Sheets

HEAT TRANSFER ENHANCING SYSTEM AND METHOD FOR FABRICATING HEAT TRANSFER DEVICE

BACKGROUND

The invention relates generally to a heat transfer device and, more particularly, to a heat transfer enhancing system for improving the heat transfer characteristics on various surfaces of the heat transfer device.

A heat transfer device, such as a heat exchanger, is a device that transmits thermal energy between a hot fluid and a cold fluid. Heat flows from the hot fluid to the cold fluid in the heat transfer device via a plurality of heat transfer surfaces such as tubes or panels. Heat exchangers may be classified into different types such as parallel flow type, counter flow type, cross flow type, single pass type, or multiple pass type. Heat exchangers used in fluid processing plants, for example liquid natural gas vaporizers or natural gas liquefiers, rely on several conventional heat transfer techniques to enhance thermal effectiveness or to enhance other heat transfer characteristics between a process fluid (e.g. liquid natural gas) side and a heat source or a heat sink side of the heat exchanger.

One conventional technique to improve thermal effectiveness involves increasing the surface area of the heat transfer surfaces. An increase in the surface area may be achieved by providing a plurality of fins, protrusions, or recesses for example, to the heat transfer surfaces, leading to an increase in the total heat flux per unit area (base surface area) of the heat transfer device resulting in a decrease in size and cost of the heat transfer device or an increase in total capacity of the device.

Another conventional technique to improve thermal effectiveness is to increase the heat transfer coefficient by providing flow turbulators or baffles to the heat transfer surfaces. However, provision of flow turbulators or baffles results in increased pressure losses in the heat transfer device.

Accordingly, there is a need for a system and a method to increase thermal effectiveness in a heat transfer device, while maintaining compact size and acceptable pressure losses.

BRIEF DESCRIPTION

In accordance with one exemplary embodiment of the present invention, a heat transfer device includes at least one heat transfer wall configured to separate a first fluid and a second fluid. A heat transfer enhancing system is provided to at least one heat transfer wall. The heat transfer enhancing system includes a plurality of micro turbulating particles that are bonded to at least one heat transfer wall, or portions thereof, using a binding medium. The heat transfer enhancing system includes a selected variation in particle size, or particle distribution density, or particle region spacing, or a combination thereof.

In accordance with another exemplary embodiment of the present invention, a natural gas heat exchanger includes at least one heat transfer wall configured to separate a first fluid and a second fluid, wherein the first fluid comprises a natural gas process fluid. A plurality of micro turbulating particles is bonded to the at least one heat transfer wall, or portions thereof, using a binding medium.

In accordance with another exemplary embodiment of the present invention, a method for manufacturing a heat transfer device includes providing at least one heat transfer wall configured to separate a first fluid and a second fluid. A heat transfer enhancing system is provided to the at least one heat transfer wall. A plurality of micro turbulating particles are bonded to the at least one heat transfer wall, or portions thereof, using a binding medium.

DRAWINGS

These and other features, aspects, and advantages of the present invention will become better understood when the following detailed description is read with reference to the accompanying drawings in which like characters represent like parts throughout the drawings, wherein.

Figure 11:
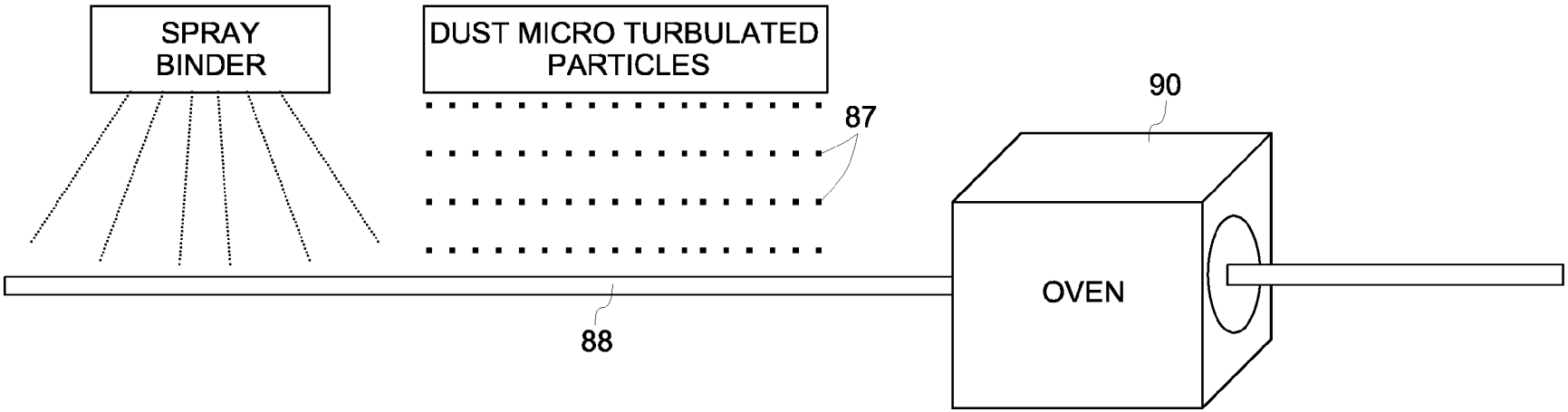
Figure 12:
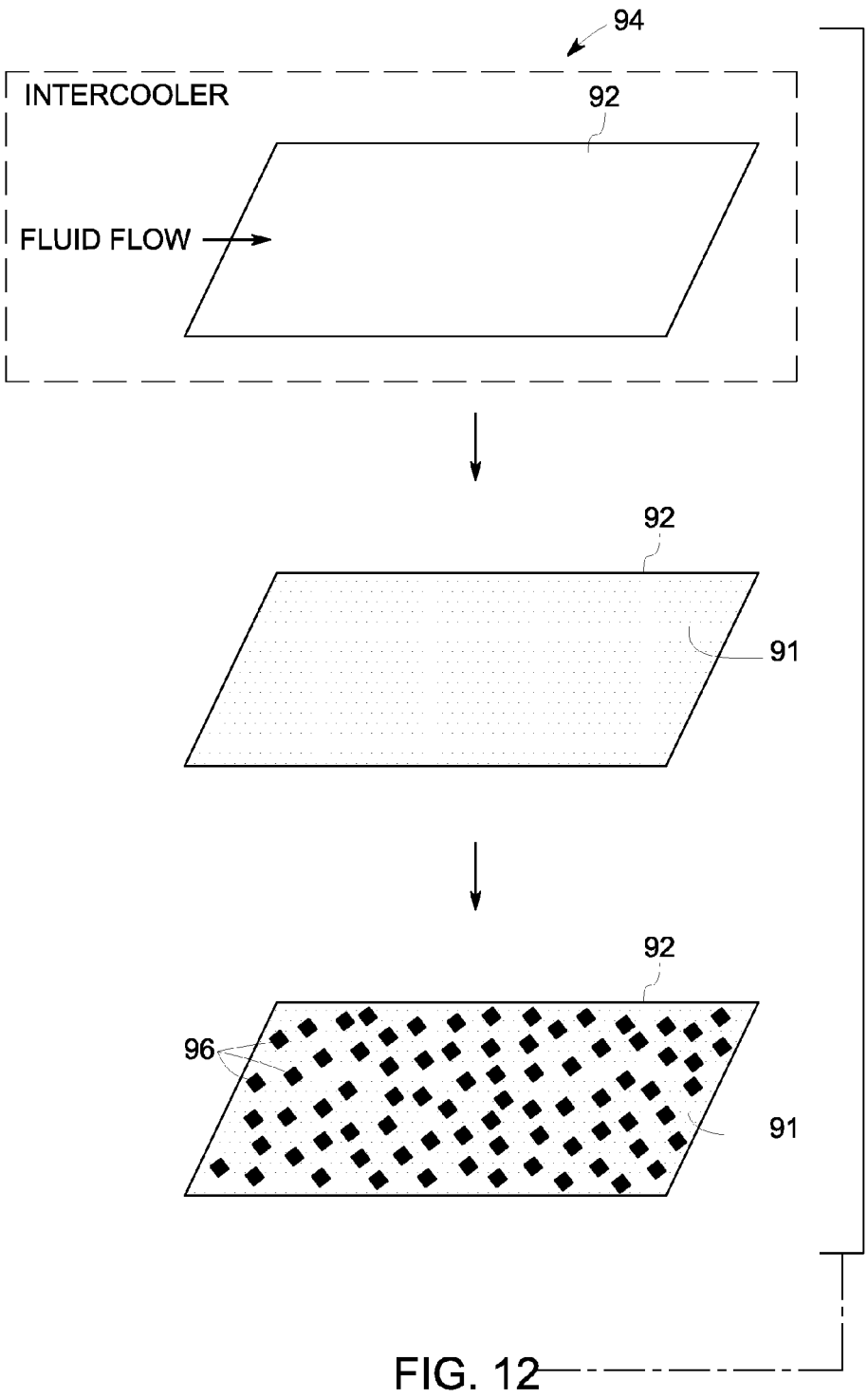

FIG. 11 is a diagrammatical view of an exemplary technique used to provide a heat transfer enhancing system to a heat transfer device, for example a heat exchanger, in accordance with an exemplary embodiment of the present invention; and FIG. 12 is a diagrammatical view of an exemplary technique used to provide a heat transfer enhancing system to a heat transfer device, for example an intercooler, in accordance with an exemplary embodiment of the present invention.

DETAILED DESCRIPTION

As discussed in detail below, embodiments of the present invention provide a heat transfer device having a plurality of heat transfer walls configured to separate a first fluid and a second fluid. An exemplary heat transfer enhancing system in accordance with the exemplary embodiments of the present invention is provided to one or more heat transfer walls. The heat transfer enhancing system includes a plurality of micro turbulating particles bonded to one or more heat transfer walls using a binding medium. The micro turbulating particles may include spherical shaped particles, or particles of different shapes depending on the requirement. Exemplary techniques in accordance with the embodiments of the present invention are used to bond the micro turbulating particles randomly or in a predetermined pattern to the heat transfer surfaces. The heat transfer enhancing system utilizes micro turbulating particles to enhance thermal effectiveness of heat transfer surfaces, such as for example, a plurality of tubes or panels in a liquid natural gas heat exchanger. Particle size, distribution density, spacing and pattern may be varied to achieve desired thermal enhancement. The "micro turbulating particle distribution density" may be referred to as average increase in wetted surface area due to the micro turbulating particles. In one example, an average increase is 50%. The micro turbulating particles act to enhance heat transfer between the first fluid and the second fluid via the heat transfer walls. Additional pressure loss in the heat transfer device is minimal. Specific embodiments of the present invention are discussed below referring generally to FIGS. 1-12.

Figure 1:
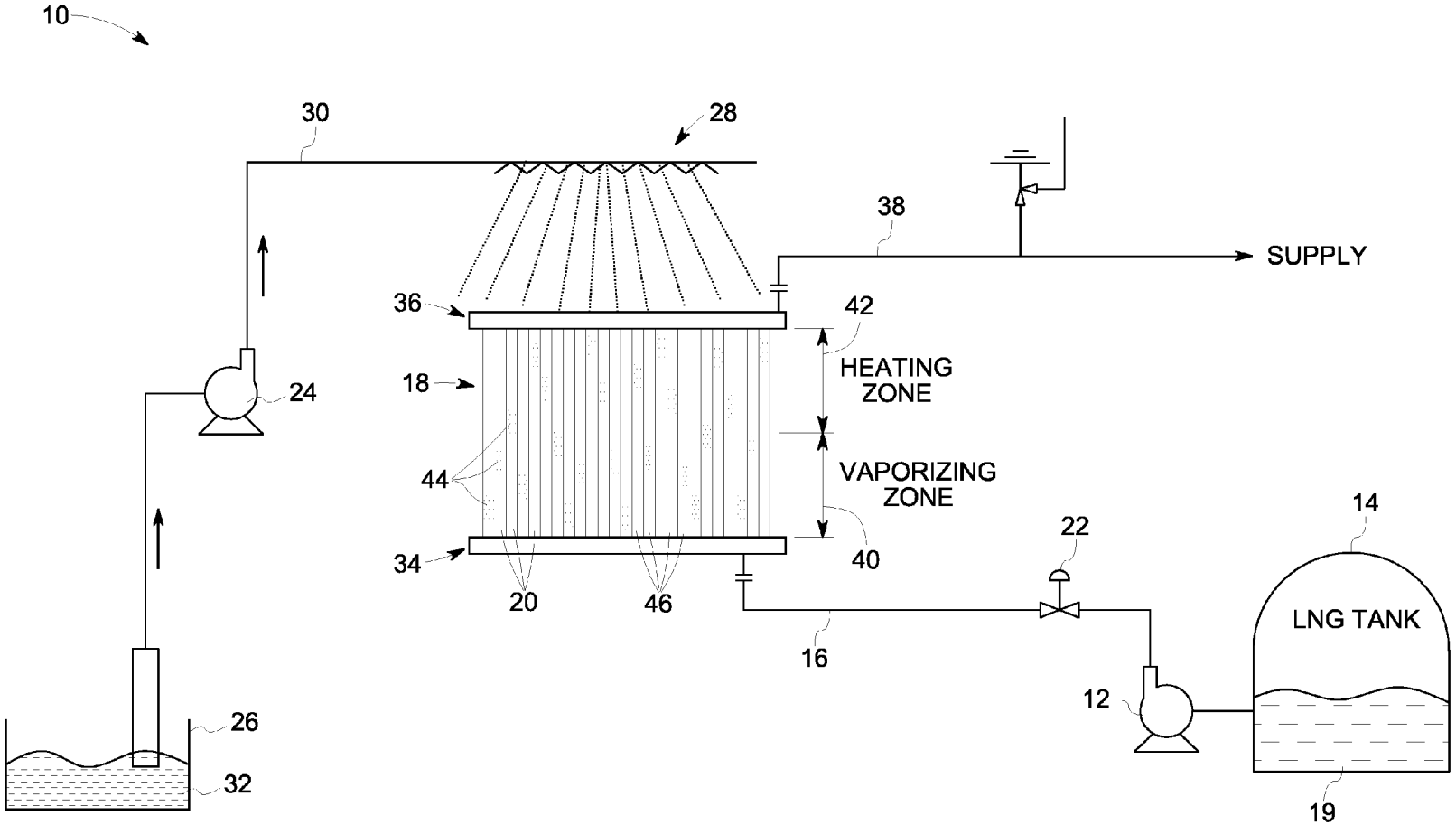
FIG. 1 is a diagrammatical view of a system having a heat transfer device, for example a liquid natural gas heat exchanger, in accordance with an exemplary embodiment of the present invention.

Referring to FIG. 1, an exemplary system 10 (for example, a liquid natural gas (LNG) system) is illustrated in accordance with an exemplary embodiment of the present invention. In the illustrated embodiment, the system 10 is an open rack vaporizer system. The illustrated system 10 includes an LNG pump 12 coupled to an LNG tank 14. The LNG pump 12 is also coupled via a pipe 16 to a panel (heat exchanger) 18. The panel 18 includes a plurality of heat transfer tubes 20 arranged proximate to each other. The LNG pump 12 is configured to supply a first fluid or a process liquid 19 (i.e. liquid natural gas) from the LNG tank 14 to the panel 18 via the pipe 16. A valve 22 is provided to the pipe 16 and configured to control the amount of liquid natural gas flowing through the pipe 16. The system 10 further includes another pump 24 coupled to an intake tank 26. The pump 24 is also coupled to a header 28 via a pipe 30. The pump 24 is configured to supply a second liquid (i.e. sea water) 32 from the intake tank 26 to the header 28 via the pipe 30. The header 28 is provided to spray sea water 32 on the plurality of tubes 20 of the panel 18. Warm sea water flows along external surfaces of the tubes 20, while liquid natural gas flows through the tubes 20 and is evaporated.

The panel 18 includes an inlet side 34 configured to intake liquid natural gas 19 and an outlet side 36 configured to discharge natural gas via a supply pipe 38. The inlet side 34 includes a vaporizing zone 40 and the outlet side 36 includes a heating zone 42. The exemplary system 10 uses sea water 32 at atmospheric pressure as the heating source for vaporizing or heating low-temperature fluids (liquid natural gas) into gases at atmospheric temperatures. The liquid natural gas is vaporized using sea water in the vaporizing zone 40 of the panel 18. The vaporized natural gas is then further heated to a higher temperature in the heating zone 42 before discharging through the supply pipe 38. In certain exemplary embodiments, an aluminum-zinc alloy is thermal-sprayed on the panel 18 to protect the panel 18 against corrosion by seawater 32. A heat transfer enhancing system 44 in accordance with the exemplary embodiments of the present invention is provided to a plurality of heat transfer walls 46 of the plurality of tubes 20 of the panel 18. In certain exemplary embodiments, the heat transfer enhancing system 44 includes a plurality of micro turbulating metallic particles bonded to the one or more heat transfer walls 46 of the tubes 20 using a binding medium. In accordance with the exemplary embodiments, a "micro turbulating particle" may be referred to as a single micro turbulating particle or an agglomeration of one or more single particles into one complex micro turbulating particle that does not allow liquid flow to penetrate inside the agglomeration. It should also be noted that "micro turbulating particle size" may be referred to as average height or diameter of a single or agglomerated micro turbulating particle. "Particle spacing" may be referred to as the local or regional average distance from one particle center to that of the adjacent particle center, expressed as a ratio of the particle size.

In alternate exemplary embodiments, the panel 18 may include a plurality of panels arranged in parallel arrays. Warm sea water flows along external surfaces of the panels, while liquid natural gas flows through the panels and is evaporated. Although the LNG vaporizer is illustrated, in certain other exemplary embodiments, the heat transfer enhancing system 44 may also be applicable to liquefiers, intercoolers, electrical and electronic thermal management devices, or the like where enhanced heat transfer rates are required. Similarly, in certain other exemplary embodiments, the system 44 may be applicable to various types of heat exchangers such as parallel flow type, counter flow type, crossed flow type, and combined flow type heat exchangers. Turbulation in accordance with the exemplary embodiments of the present invention may be utilized to treat a variety of components including combustor liners, combustor domes, vanes or blades, or shrouds of gas turbines. The exemplary turbulation techniques may also be used to treat shroud clearance control areas including flanges, casings, and rings.

The micro turbulating particles increase the surface area and the heat transfer coefficient of the heat transfer walls 46 that results in increased heat transfer rates and reduced relative pressure losses compared to other augmentation methods. Processing of the heat transfer walls may be customized depending on the requirement and differing levels of desired thermal enhancement. Specific embodiments of the present invention are discussed below referring generally to FIGS. 1-12.

Figure 2:
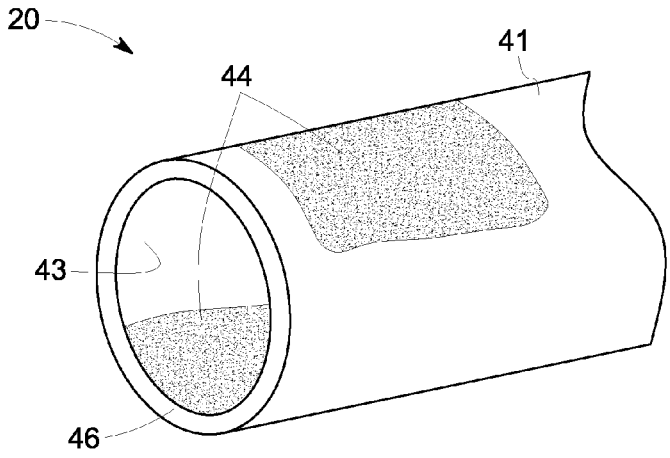
FIG. 2 is a perspective view of a heat exchanger tube having a heat transfer enhancing system in accordance with aspects of the embodiment of FIG. 1.

Referring to FIG. 2, the heat transfer tube 20 in accordance with the aspects of FIG. 1 is illustrated. In the illustrated embodiment, the heat transfer enhancing system 44 is provided to an exterior surface 41 and an interior surface 43 of the heat transfer wall 46 of the tube 20. As described previously, the system 44 includes a plurality of micro turbulating particles bonded to the surfaces 41, 43 of the tube 20 using a binding medium. In certain exemplary embodiments, the plurality of micro turbulating particles may include nickel, cobalt, aluminum, silicon, or iron, or alloys thereof, or a combination including any of the foregoing. The binding medium may include epoxy, or metal foil, or solder, or braze material, or weld material, or a combination thereof. It should be noted that the above-mentioned list of materials of the micro turbulating particles and binding medium are not exhaustive and other metallic material or metallic alloys suitable for enhancing heat transfer characteristics are also envisaged. The amount and type of binder generally ensures sufficient adhesive strength of the micro turbulating particles to the heat transfer wall in system 44.

In the illustrated embodiment, the micro turbulating particles are applied randomly to the surfaces 41, 43 of the tube 20. In certain other embodiments, the micro turbulating particles may be randomly or partially provided to the heat transfer walls of the vaporizing zone and the heating zone of the panel. In certain other embodiments, the micro turbulating particles are uniformly bonded to one or more heat transfer walls of the tubes 20. In certain other embodiments, the micro turbulating particles are bonded in a predetermined pattern to one or more heat transfer walls of the tubes 20. The provision of the micro turbulating particles may be varied in different zones of the heat exchanger depending on the thermal potential of the zones. In accordance with the exemplary embodiments of the present invention, the increase in heat transfer is largely due to increased micro turbulated surface area of the tube. The micro turbulating particles may also increase heat transfer by modifying fluid flow characteristics such as from laminar flow to turbulent flow along the heat transfer surfaces. It should noted that the fluid flow along the heat transfer surface having enhanced heat transfer characteristics may include channel type fluid flow and impinging type fluid flow.

Figure 3:
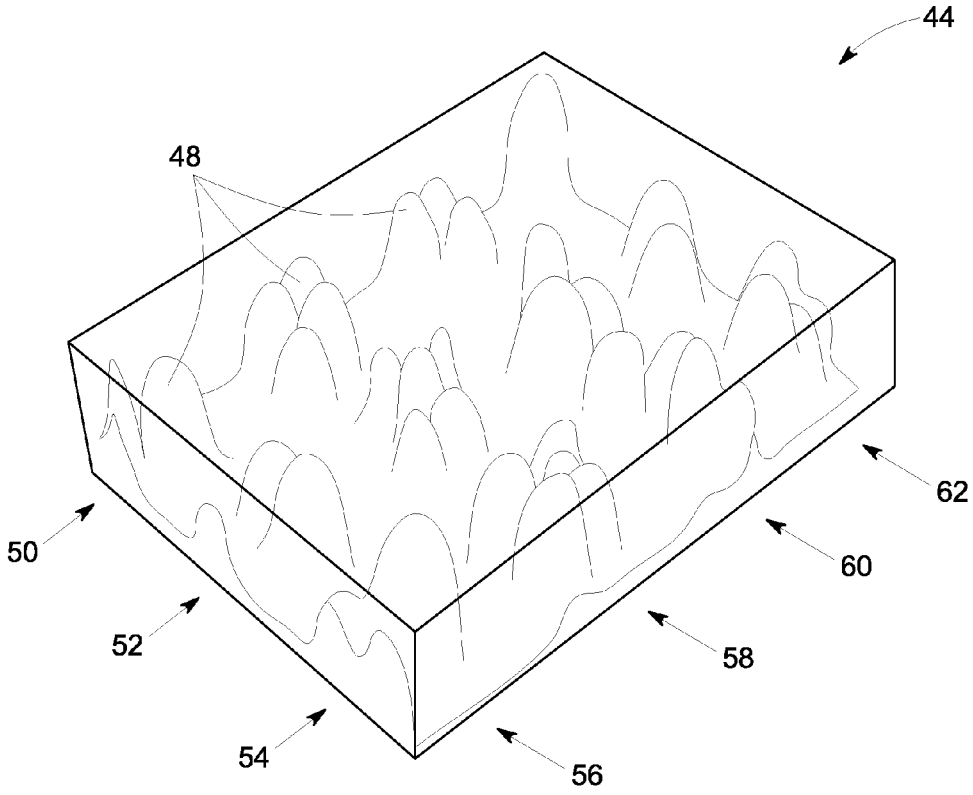
FIG. 3 is a diagrammatical view of a heat transfer enhancing system in accordance with an exemplary embodiment of the present invention.

Referring to FIG. 3, the heat transfer enhancing system 44 in accordance with an exemplary embodiment of the present invention is illustrated. The system 44 includes a plurality of protuberances 48 provided in a predetermined pattern to a heat transfer wall 46 of the heat transfer tube. The plurality of protuberances together defines "turbulation", which appears as a roughened surface that is effective to increase heat transfer through the heat transfer wall 46. Even though the protuberances are shown approximately spherical shaped, other shapes may also be envisaged to meet the desired roughness and surface area characteristics and thus obtain a desired heat transfer enhancement. In the illustrated embodiment, the protuberances 48 are provided along three rows 50, 52, 54 and four columns 56, 58, 60, and 62 to the heat transfer wall 46. In certain exemplary examples, the height "h" of each protuberance 48 is 9 mils (0.009 inches). It should be noted that value of height "h" should not be construed as a limiting value and may vary depending on the heat transfer requirement. Each protuberance 48 includes one or more of micro turbulating particles packed closely together. The protuberances 48 are bonded to the heat transfer surface 46 using the binding medium. It should again be noted that the illustrated example is merely an exemplary embodiment and that particle size, distribution density, spacing and pattern may be varied to achieve desired thermal enhancement. Size of the particles is determined based on the desired degree of surface roughness and surface area that will be provided by the protuberances. The micro turbulating particles facilitate enhanced heat transfer between the first fluid and the second fluid via the heat transfer wall 46. Additional pressure loss in the heat transfer device is minimal relative to that without the system 44.

In accordance with the exemplary embodiments, the pattern may include predetermined limits on the relative size/spacing of the micro turbulating particles applied to the heat transfer wall 46. In certain exemplary embodiments, if the average height of the micro turbulating particle is characterized as "H", and the average micro turbulating particle diameter is characterized as "D", then the spacing between mutually adjacent micro turbulating particles may be in the range of 2 to 8 times the average diameter (D). In certain examples, the micro turbulating particle height (H) may be in the range of 1 to 6 times the average diameter (D) of the micro turbulating particle.

Figure 4:
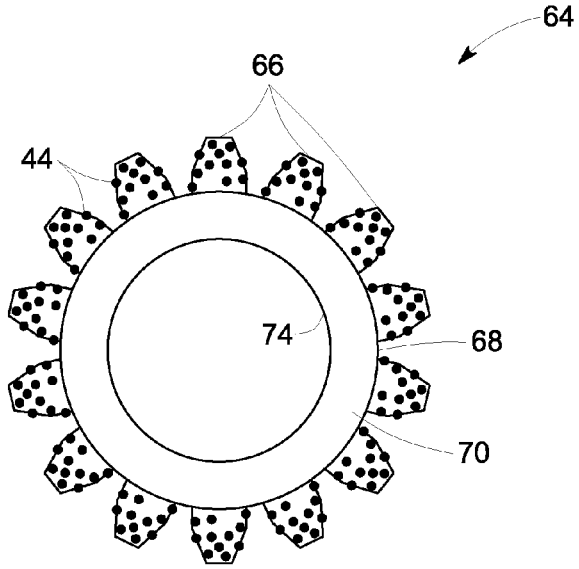
FIG. 4 is a diagrammatical view of a heat transfer device provided with a plurality of fins having a transfer enhancing system in accordance with an exemplary embodiment of the present invention.

Referring to FIG. 4, an exemplary embodiment of an extruded heat transfer tube 64 of the open rack vaporizer is illustrated. In the illustrated embodiment, the heat transfer tube 64 is an extruded tube having a plurality of fins 66 provided on an exterior surface 68 of a heat transfer wall 70. The fins 66 may include plain type fins, or perforate type fins, or herringbone type fins, or serrated type fins, or a combination thereof. An exemplary heat transfer enhancing system 44 in accordance with certain embodiments of the present invention is provided to the plurality of fins 66 provided on the exterior surface 68 of the heat transfer wall 70. The heat transfer enhancing system 44 includes a plurality of micro turbulating particles bonded to the plurality of fins 66 using the binding medium. The micro turbulating particles and the binding medium are applied to the fins 66 using techniques such as spraying, or slurry painting, or flame spray, or dipping, or a combination thereof. In some cases, the binder may be thermally matured to realize bond strength (e.g. solder, braze). The micro turbulating particles increase the micro turbulated surface area and heat transfer coefficient of the heat transfer wall 70 that results in enhanced heat transfer rates and reduced relative pressure losses.

Figure 5:
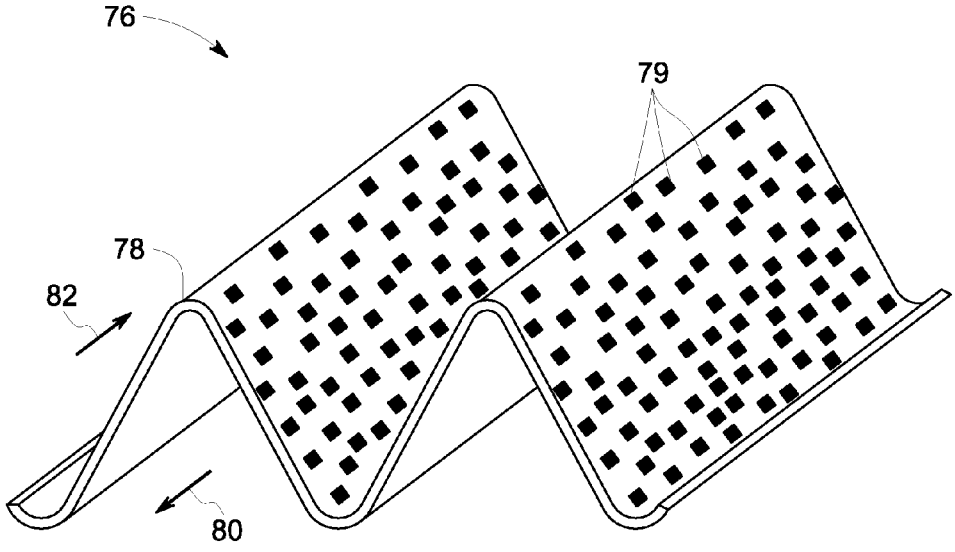
FIG. 5 is a perspective view of a heat transfer device having a corrugated panel provided with a heat transfer enhancing system in accordance with an exemplary embodiment of the present invention.

FIG. 5 is a perspective view of a heat transfer device 76 (heat exchanger) in accordance with other aspects of the present invention. The heat transfer device 76 includes a corrugated panel 78 in which the process fluid and heating/cooling fluid flows in alternate channels 80, 82 respectively. The exemplary heat transfer enhancing system 44 in accordance with aspects of the present invention is provided and includes a plurality of micro turbulating particles 79 bonded to one side or both sides of the corrugated panel 78 using the binding medium. The micro turbulating particles 79 and the binding medium are applied to the corrugated panel 78 using techniques such as spraying, or slurry, or dipping, or sprinkling, or flame spray, or roll coating, or a combination thereof and then heat treated to perform curing. The micro turbulating particles 79 increase the micro turbulated surface area and heat transfer coefficient of the corrugated panel 78 that results in enhanced heat transfer rates and reduced relative pressure losses. Here again, it should be noted that the illustrated example is merely an exemplary embodiment and that particle size, spacing and pattern may be varied to achieve desired thermal enhancement.

Figure 6:
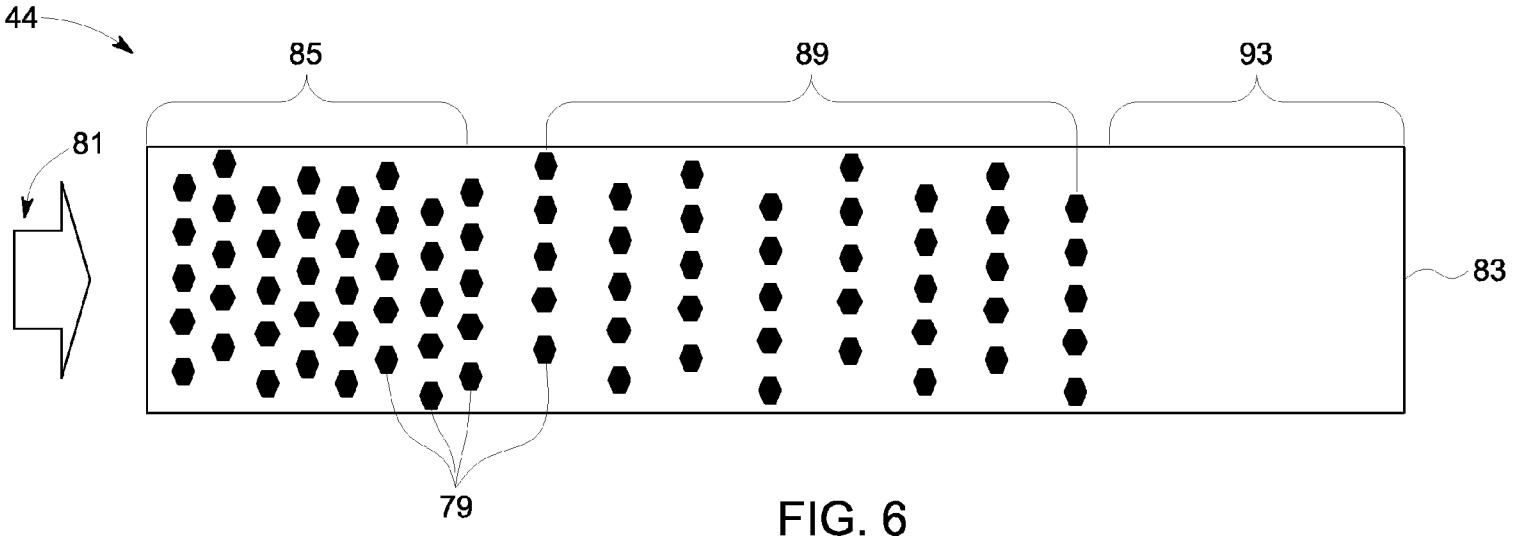
FIG. 6 is a diagrammatical view of a heat transfer enhancing system in accordance with an exemplary embodiment of the present invention.

Referring to FIG. 6, the heat transfer enhancing system 44 in accordance with an exemplary embodiment of the present invention is illustrated. In the illustrated embodiment, the direction of flow of the process fluid and/or the heating/cooling fluid is indicated by the arrow 81 with respect to a flat heat transfer plate 83. The heat transfer plate 83 includes an inlet region 85, a middle region 89, and an exit region 93. The system 44 includes the plurality of micro turbulating particles 79 bonded to one side or both sides of the heat transfer plate 83 using the binding medium. In the illustrated embodiment, the micro turbulating particle distribution is concentrated in the inlet region 85 and the middle region 89. The exit region 93 of the plate 83 is maintained smooth. The micro turbulating particles 79 are closely packed together in the inlet region 85 whereas spacing between the micro turbulating particles is greater in the middle region 89. The micro turbulating particles 79 increase the micro turbulated surface area and heat transfer coefficient of the heat transfer plate 83 that results in enhanced heat transfer rates and reduced relative pressure losses.

Figure 7:
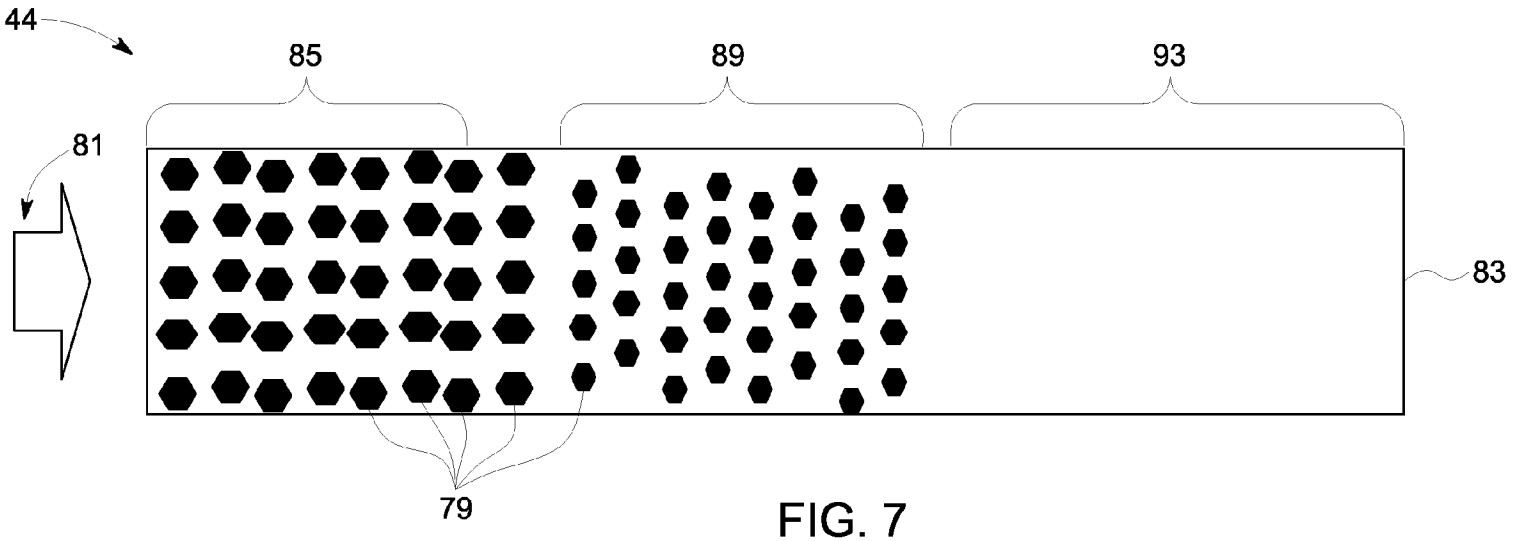
FIG. 7 is a diagrammatical view of a heat transfer enhancing system in accordance with an exemplary embodiment of the present invention.

Referring to FIG. 7, the heat transfer enhancing system 44 in accordance with an exemplary embodiment of the present invention is illustrated. As discussed in the previous embodiment, the heat transfer plate 83 includes the inlet region 85, the middle region 89, and the exit region 93. The system 44 includes the plurality of micro turbulating particles 79 bonded to one side or both sides of the heat transfer plate 83 using the binding medium. In the illustrated embodiment, the micro turbulating particle distribution is concentrated in the inlet region 85 and the middle region 89. The exit region 93 of the plate 83 is maintained smooth. In the illustrated embodiment, the size of micro turbulating particles 79 in the inlet region 85 is greater than the size of particles in the middle region 89.

Figure 8:
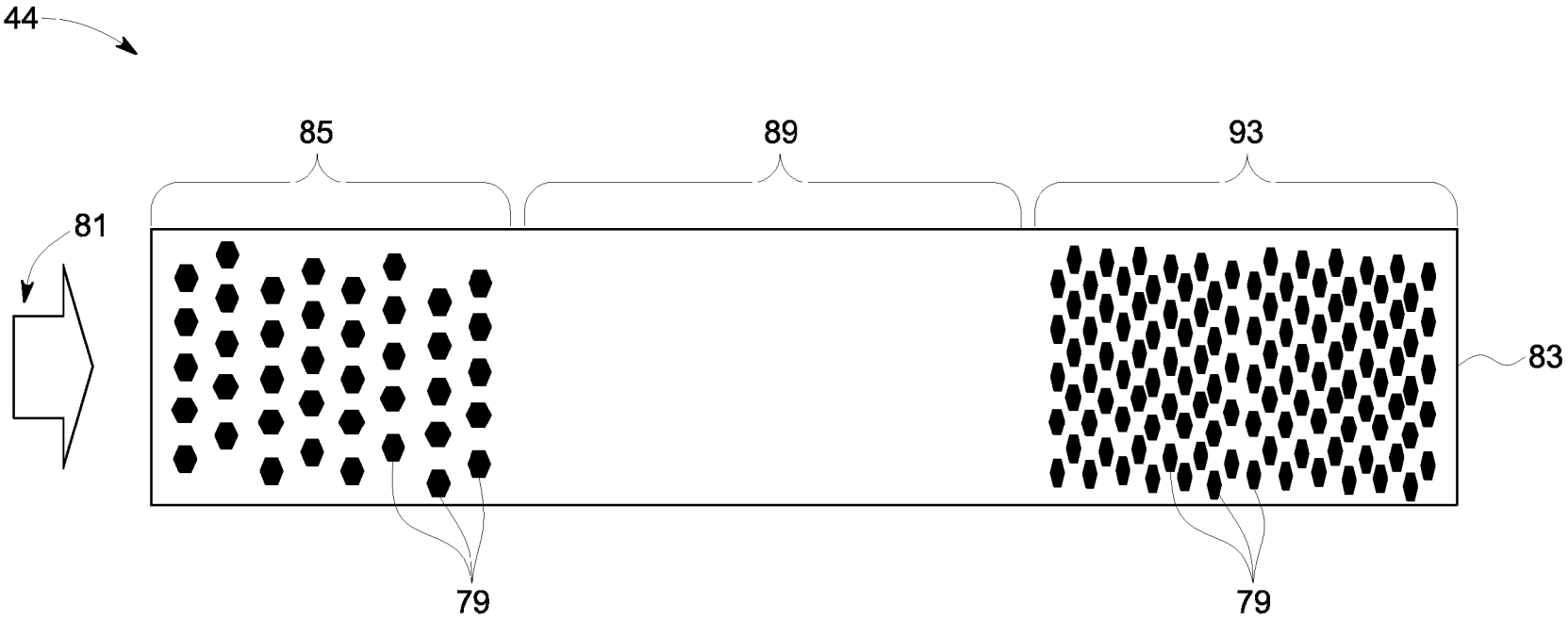
FIG. 8 is a diagrammatical view of a heat transfer enhancing system in accordance with an exemplary embodiment of the present invention.

Referring to FIG. 8, the heat transfer enhancing system 44 in accordance with an exemplary embodiment of the present invention is illustrated. In the illustrated embodiment, the heat transfer plate 83 includes the inlet region 85, the middle region 89, and the exit region 93. The system 44 includes the plurality of micro turbulating particles 79 bonded to one side or both sides of the heat transfer plate 83 using the binding medium. In the illustrated embodiment, the micro turbulating particle distribution is concentrated in the inlet region 85 and the exit region 93. The middle region 87 is maintained smooth. In the illustrated embodiment, the size of micro turbulating particles 79 in the inlet region 85 is greater than the size of particles in the exit region 93. The particle distribution density in the exit region 93 is greater than the distribution density in the inlet region 85 (i.e. the micro turbulating particles 79 are closely packed in the exit region 93 whereas spacing between the micro turbulating particles in the inlet region 85 is greater). The particle distribution density is also characterized by the particle shaping, or agglomeration sizes, or size, or a combination thereof and creation of wetted surface area/flow turbulation.

Figure 9:
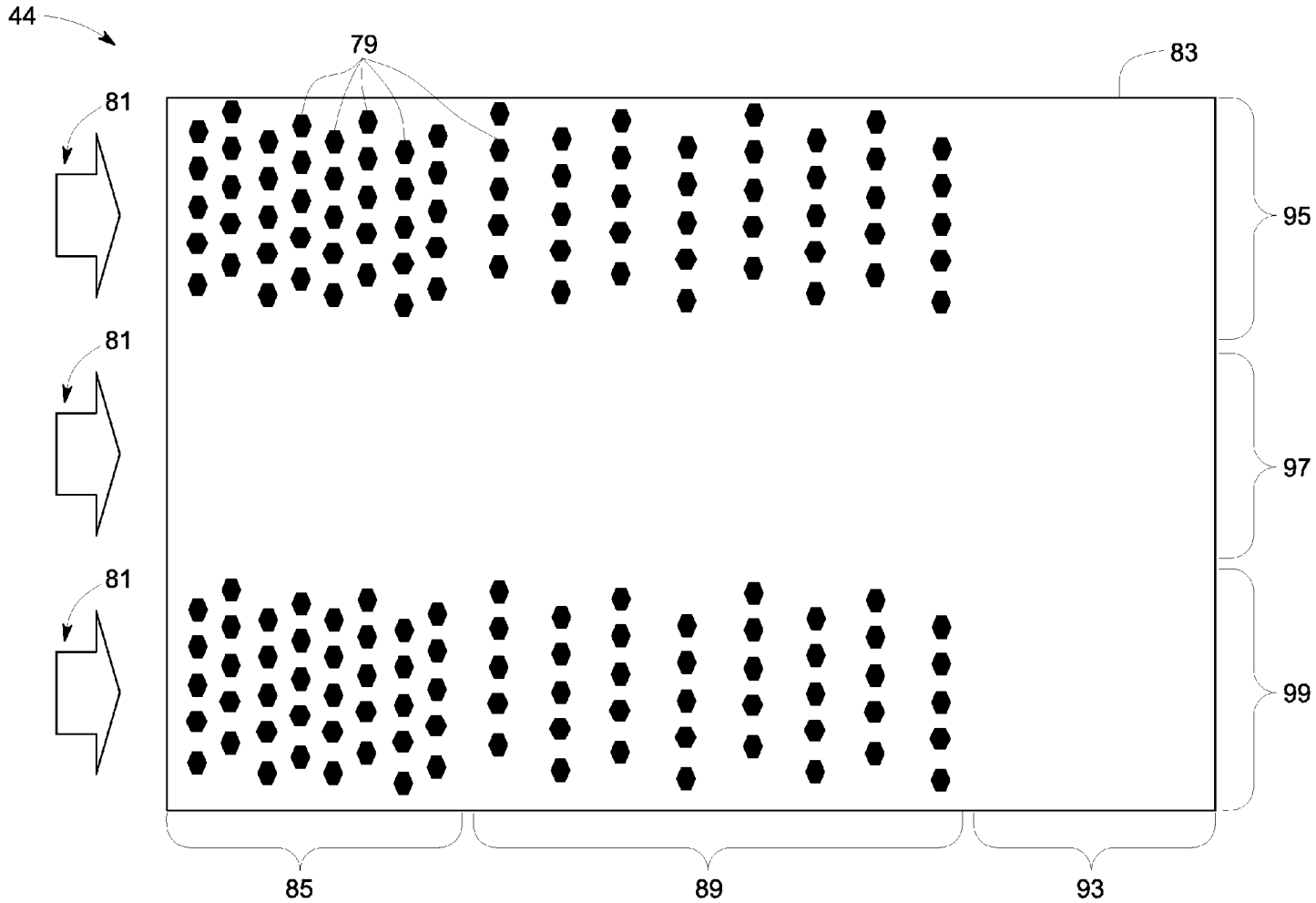
FIG. 9 is a diagrammatical view of a heat transfer enhancing system in accordance with an exemplary embodiment of the present invention.

Referring to FIG. 9, the heat transfer enhancing system 44 in accordance with an exemplary embodiment of the present invention is illustrated. In the illustrated embodiment, the heat transfer plate 83 includes a top region 95, an intermediate region 97, and a lower region 99. The system 44 includes the plurality of micro turbulating particles 79 bonded to one side or both sides of the heat transfer plate 83 using the binding medium. In the illustrated embodiment, the micro turbulating particle distribution is concentrated in the top region 85 and the lower region 99. The intermediate region 97 is maintained smooth. In the illustrated embodiment, the size of micro turbulating particles 79 in the inlet region 85 is greater than the size of particles in the exit region 93. It should be noted that in the illustrated embodiment and previous embodiments, although flat shaped heat transfer plate 83 is illustrated, the system 44 is also suitable for other surfaces including three dimensional, curved, concave, convex, multiply curved, intersections, or a combination thereof. It should be noted that the above described embodiments may be selected depending on the type of heat transfer device used and also the thermodynamic distribution.

Figure 10:
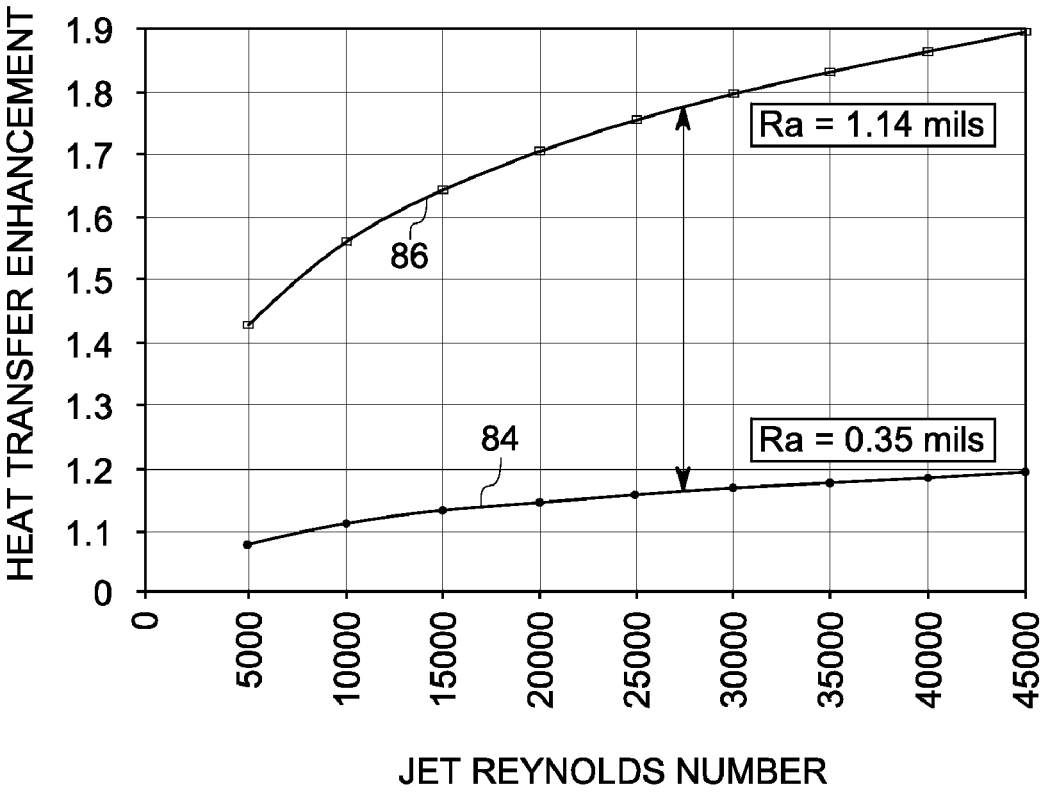
FIG. 10 is a graph representing variation of jet Reynolds number versus heat transfer enhancement in accordance with an exemplary embodiment of the present invention.

Referring to FIG. 10, a graph representing variation of fluid jet Reynolds number (x-axis) versus heat transfer enhancement (y-axis) for impinging type fluid flow in accordance with an exemplary embodiment of the present invention is illustrated. As known to those skilled in the art, the Reynolds number is the ratio of inertial forces to viscous forces and is used for determining whether a flow will be laminar or turbulent. Heat transfer enhancement is the ratio of heat transfer coefficient for a micro turbulated surface to the heat transfer coefficient for a smooth surface.

The illustrated graph shows variation of jet Reynolds number versus heat transfer enhancement for two heat transfer walls having different surface roughnesses. Curve 84 represents variation of jet Reynolds number versus heat transfer enhancement for a heat transfer wall having an average surface roughness (Ra) equal to 0.35 mils (i.e. 0.00035 inches). Curve 86 represents variation of jet Reynolds number versus heat transfer enhancement for a heat transfer wall having an average surface roughness (Ra) equal to 1.14 mils (0.00114 inches). It may be observed that heat transfer rates across the heat transfer walls increases with increase in average surface roughness. The illustrated graph is merely an exemplary embodiment and the variation of jet Reynolds number versus heat transfer enhancement may vary depending on the particle size, spacing and pattern applied to achieve desired thermal enhancement. In certain exemplary embodiments, the average surface roughness values are typically 7 to 12 times less than the actual particle size for random surfaces, and depend on particle spacing for non-random surfaces.

Referring to FIG. 11, an exemplary technique used to provide a heat transfer enhancing system to a heat transfer device, for example a heat exchanger, in accordance with an exemplary embodiment of the present invention. The illustrated exemplary technique involves spraying a binding medium to a heat transfer tube 88 of a heat exchanger. The binding medium may include epoxy, or metal foil, or solder, or braze material, or weld material, or a combination thereof. The micro turbulating particles 87 are dusted over the binding medium applied to the heat transfer tube 88. It should be noted that other exemplary techniques for applying micro turbulating particles over the binding medium applied to the heat transfer tube 88 are also envisaged. The micro turbulating particles 87 are bonded randomly or in a predetermined pattern to the heat transfer surface of the heat transfer tube 88. The plurality of micro turbulating particles may include nickel, or cobalt, or aluminum, or silicon, or iron, or copper, or a combination thereof. The particle size, spacing and pattern may also be varied to achieve desired thermal enhancement. In certain exemplary embodiments, the heat transfer tube 88 may be rotated for applying micro turbulating particles 87 over the binding medium applied to the heat transfer tube 88. In certain other exemplary embodiments, the micro turbulating particles 87 may be applied from different angles over the binding medium applied to the heat transfer tube 88. The heat transfer tube 88 is then passed through an oven 90 for thermal heat treatment to cure the micro turbulating particles 87.

FIG. 12 illustrates an exemplary technique used to provide a heat transfer enhancing system to a heat transfer device 94, for example an intercooler, in accordance with an exemplary embodiment of the present invention. The exemplary technique involves spraying or applying a binding medium 91 such as a film of high conductivity epoxy to a heat transfer surface 92 of an intercooler 94. As described in previous embodiments, a plurality of micro turbulating particles 96 are sprayed randomly or in predetermined pattern over the binding medium applied to the heat transfer surface 92 of the intercooler 94. The micro turbulating particles 96 may be then heat treated for curing. In certain other exemplary embodiments, a binding medium such as aluminum foil or solder foil are applied to the heat transfer surface 92 of the intercooler. Then the plurality of micro turbulating particles 96 are sprayed randomly or in predetermined pattern over the aluminum foil or solder foil applied to the heat transfer surface 92. The foil and the particles are then heat treated to bond the particles to the heat transfer surface 92. In certain other exemplary embodiments, a binding medium such as a braze alloy may be dip coated to the heat transfer surface 92 of the intercooler 94. Then the plurality of micro turbulating particles 96 are sprayed randomly or in predetermined pattern over the braze alloy applied to the heat transfer surface 92. The braze alloy and the particles are then heat treated to bond the particles to the heat transfer surface 92.

In certain exemplary embodiments of the exemplary technique, the binding medium and the micro turbulating particles are applied simultaneously to the heat transfer surface 92 and then heat treated to bond the binding medium and the particles to the heat transfer surface. The application of binding medium and the micro turbulating particles may be done by techniques such as spraying, or screen printing, or roll coating, or a combination thereof. The patterning of the binding medium on the heat transfer surface may be performed through patterned masking, or screen printing, or roll printing, or a combination thereof. In certain exemplary embodiments, the micro turbulating particles are patterned to the heat transfer surface 92 through a screen by a screen printing technique. Alternately or additionally, the binding medium is applied through the screen to the heat transfer surface. Removal of the screen results in the predetermined pattern formed on the heat transfer surface. A pattern in accordance with aspects of the present invention may be defined as plurality of "clusters" of particles (one or more particles), wherein the clusters are generally spaced apart from each other by a pitch corresponding to the spacing of openings in the screen. The excess particles are removed resulting in the desired pattern of the particles. The binding medium may be applied using sprayers, or brushes, or squeegee, or trowel, or as sheets, or a combination thereof. In certain exemplary embodiments, the micro turbulating particles may also be patterned to the heat transfer surface by screen printing. The binding medium and the particles may be cured by thermal heat treatment, or ultra violet rays, or spray activator, or a combination thereof. In certain other exemplary embodiments, a pre-turbulated sheet having micro turbulating particles and binding medium may be bonded to the heat transfer surface.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A natural gas heat exchanger, comprising:

at least one heat transfer wall configured to separate liquid natural gas and sea water, a heat transfer enhancing system provided to the at least one heat transfer wall and comprising a plurality of micro turbulating particles bonded to the at least one heat transfer wall, or portions thereof, using a binding medium, wherein at least some of the micro turbulating particles are bonded together to form one or more agglomerations of micro turbulating particles, wherein each of the one or more agglomerations of micro turbulating particles does not allow liquid flow to penetrate inside the agglomeration, and an open rack vaporizer having the at least one heat transfer wall.

2. The heat exchanger of claim 1, wherein the open rack vaporizer comprises a heating zone and a vaporizing zone having the plurality of micro turbulating particles provided in a predetermined pattern to the heating zone and the vaporizing zone using the binding medium.

3. The heat exchanger of claim 1, wherein the plurality of micro turbulating particles are bonded to a plurality of fins or protrusions on the at least one heat transfer wall using the binding medium.

4. The heat exchanger of claim 1, wherein the plurality of micro turbulating particles are bonded to an outlet side of the heat transfer wall, wherein the outlet side includes a heating zone.

5. The heat exchanger of claim 1, wherein the one or more agglomerations comprises at least two agglomerations bonded to the heat transfer wall but not bonded to each other.

6. The heat exchanger of claim 1, wherein spacing between micro turbulating particles is in the range of 2 to 8 times an average diameter of the micro turbulating particle.

7. The heat exchanger of claim 1, wherein each micro turbulating particle has a height in the range of 1 to 6 times an average diameter of the micro turbulating particles.

* * * * *